US007012524B2

(12) United States Patent
Hisano et al.

(10) Patent No.: US 7,012,524 B2
(45) Date of Patent: Mar. 14, 2006

(54) ANTI-INTRUDER SECURITY SYSTEM WITH SENSOR NETWORK AND ACTUATOR NETWORK

(75) Inventors: Atsushi Hisano, San Jose, CA (US); Masanori Kameyama, Los Altos, CA (US)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 10/638,534

(22) Filed: Aug. 12, 2003

(65) Prior Publication Data

US 2005/0073404 A1 Apr. 7, 2005

Related U.S. Application Data

(60) Provisional application No. 60/452,553, filed on Mar. 7, 2003.

(51) Int. Cl.
*G08B 13/00* (2006.01)

(52) U.S. Cl. ..... 340/541; 340/506; 340/573.4

(58) Field of Classification Search ..... 340/541, 340/5.2, 5.8, 528, 545.1, 522, 573.4, 556, 340/506, 547

See application file for complete search history.

(56) References Cited

U.S. PATENT DOCUMENTS 5,708,417 A * 1/1998 Tallman et al. ..... 340/539.23
5,793,290 A * 8/1998 Eagleson et al. ..... 340/573.4
5,838,234 A * 11/1998 Roulleaux-Robin ..... 340/572.3
6,057,764 A * 5/2000 Williams ..... 340/572.1
6,337,626 B1 * 1/2002 Huang ..... 340/541
6,353,385 B1 * 3/2002 Molini et al. ..... 340/506
6,404,338 B1 * 6/2002 Koslar ..... 340/571
6,720,874 B1 * 4/2004 Fufido et al. ..... 340/541

* cited by examiner

*Primary Examiner*—Anh V. La
(74) *Attorney, Agent, or Firm*—Foley & Lardner LLP

(57) ABSTRACT

The system in one embodiment operates while automatically switching among three processes including an absent-at-home guard process, an at-home guard process, and a non-guard process according to the positional relationship between the movable localizer and the internal guard surfaces/the external guard surface. When an actuator (such as a speaker and a white smoke generating unit) is integrated into the localizer, the localizer located at an intruder generates alarm sound or white smoke in the absent-at-home guard process. When the intruder moves inside the house, the localizer generating the alarm sound and the localizer generating the white smoke change following the intruder. The actuator is controlled such that an intruder is discouraged to approach the internal guard surface or such that a house member inside the internal guard surface can evacuate in a direction departing from the intruder in the at-home guard process.

20 Claims, 7 Drawing Sheets

SYSTEM CONCEPTUAL DRAWING

SYSTEM APPLIED TO VEHICLE (TOP VIEW)

FLOWCHART FOR PROCESS IN EXECUTION MODE AT CONTROL LOCALIZER

REPULSION OF INTRUDER AND EVACUATION GUIDANCE FOR RESIDENTS

ANTI-INTRUDER SECURITY SYSTEM WITH SENSOR NETWORK AND ACTUATOR NETWORK

CROSS-REFERENCE TO RELATED PATENT APPLICATIONS

This application is a Non-Provisional of U.S. Application 60/452,553, filed Mar. 7, 2003, incorporated herein by reference in its entirety.

BACKGROUND OF THE INVENTION

1. Technical Field of the Invention

The present system relates to a security system using a sensor network constituted by nodes where multiple nodes, which can transmit ID information on a node, and simultaneously, can conduct inter-node distance measuring and inter-node intrusion detection, are disposed in a facility such as a residential house, a warehouse, an office, a plant, a hospital, a school, and a vehicle, and simultaneously, an authorized member of the facility carries the node, and relates to a security system using an actuator network where the node further provided with an actuator, and the actuator is properly operated according to the position of an intruder.

2. Description of the Related Art (1) Japanese Patent Laid-Open No. H10-27292 Publication discloses the following art.

[Problems] To prevent neglect of setting a guard mode for reporting a security company of a door breakage, and to assure high security.

[Means for Solving the Problems] While a facility such as a store is closed, a person who leaves last can open a door D0 used for leaving last, and can go home only after locking doors D1 to D6 to be guarded, and simultaneously setting a guard mode. During standard business hours until PM 5:00, the door D0 for leaving last is freely opened from the inside, and the condition required for opening the door is to set the guard mode after PM 5:00.

(2) Japanese Patent Laid-Open No. H08-249550 Publication discloses the following art.

[Object] To provide a home security apparatus enabling operating a single set button to set/reset a state of monitoring door lock even when multiple systems of security sensors are connected.

[Constitution] By pressing single set button included in a home security apparatus according to the present invention for less than a first predetermined period within a second predetermined period, monitor modes are sequentially changed as a loop. After the second predetermined period has elapsed, the monitor mode is determined, and multiple systems of security sensors are set to a monitor state. When the set button is pressed for a period longer than the first predetermined period, the monitor state of the multiple systems of the security sensors is reset by operating the single set button.

(3) Japanese Patent Laid-Open No. 2001-56887 Publication discloses the following art.

[Problems] To provide a method and an apparatus for detecting intrusion for avoiding a false report due to a small animal and disturbing light, correctly detecting intrusion through an opening to be guarded such as a window and an entrance/exit of a building, and enabling easy installation.

[Means for Solving the Problems] A first sensor 2X having a detection area 7A at subjects to be guarded 5 and 6, and on the front side of an upper part of them, and a second sensor 2Y having a detection area 7B at the subjects to be guarded 5 and 6, and on the front side of a lower part of them are provided. Further, at least either of the first and second sensors 2X and 2Y is provided with a logic circuit including timer 13, and simultaneously, at least the other one of them is provided with an output path 17 for supplying the outside with a detection signal from a detection unit 10 inside the sensor. The logic circuit including timer 13 generates an alarm signal (b) when it receives a detection signal (a) from the detection unit 10 inside the sensor 2X provided with the logic circuit including timer 13, and it receives the detection signal (a) provided through the output path 17 of the other sensor 2Y within a predetermined period.

(4) Japanese Patent Laid-Open No. H05-114091 Publication discloses the following art.

[Object] To determine that actual alarm is necessary only when a window is opened from the outside, and to release intrusion alarm.

[Constitution] When a window is open, and a detection signal from an indoor intrusion sensor 5 is supplied for a data processing unit 2, it is determined whether a detection signal indicating that an outdoor intrusion sensor 6 for monitoring a predetermined location outside the window detects an intruder within a last few seconds, is supplied for the data processing unit 2 or not. As a result of the determination, when the condition is satisfied, an internal alarm unit 13 and a speaker 15 are used to internally alarm with sound, and simultaneously, a terminal 14 for connecting an upper system reporting unit 12 and a telephone line with each other is used to report to an upper system, thereby releasing actual alarm. When the condition is not satisfied, the case is treated as a false alarm, and the internal alarm and the upper system report are not conducted.

In a conventional residential house security system (home security system), it is bothering to change the mode of the residential house security system, and an error in changing the mode leads to a false alarm, and a failure of detecting an intrusion.

In Japanese Patent Laid-Open No. H10-27292 Publication, for attaining the object of eliminating the mode setting change error, the operation becomes inconvenient such that "a person who leaves last can open a door D0 used for leaving last, and go home only after locking doors D1 to D6 to be guarded, and simultaneously setting a guard mode". In Japanese Patent Laid-Open No. H08-249550 Publication, since button operation is necessary for changing mode setting, the mode setting cannot be changed if the button operation is neglected. Also, even if an intruder is detected, as much as a sound alarm is generated, the intruder is not effectively repulsed.

The following section analyzes the problem above, and describes "problem points" which cause the problem In the following description, though the description is mainly provided for a residential house, the description applies to a facility such as a residential house, a warehouse, an office, a plant, a hospital, a school, and a vehicle.

The following points are necessary to reduce the false alarm of the intruder alarm of the residential house security system.

(1) To start/stop an "absent-at-home guard process" at proper timing, which determines that an intruder is present when a human motion or a opening/closing door of a house is detected inside the house while a resident is not at home.

(2) To properly start/stop an "at-home guard process", which determines that an intruder is present if a door or a window of the house is opened/closed when a resident is present at a certain place inside the house.

(3) To repulse an intruder at a proper place and timing.

SUMMARY OF THE INVENTION

In view of the problems of the prior art, the objects of the present invention are set as follows.

(1) Automatically setting/resetting the guard mode without button operation to reduce the frequency of the false alarm.

(2) Enabling easily setting an area for setting/resetting the guard mode.

(3) Effectively repulsing an intruder.

(4) Properly providing an authorized member with evacuation guidance.

A node, which can wirelessly transmit a predetermined ID code, can wirelessly measure the distance to another node or can measure the location of the node itself, further, can detect intrusion when an intruder exists between itself and another node, and can wirelessly transmit information detected by itself, is referred to as a localizer hereafter.

Further, the positional change of the localizer itself, and intrusion into a sensing area between the localizers can be detected. The localizer includes a fixed localizer whose position is supposed not to change, and a control localizer which is responsible for a communication function with the outside, and a control function for integrating and storing state information on the all localizers in the system, and whose position is supposed not to change. The control localizer is set as the origin of a coordinate system for measuring a location. Then, additional three other localizers are disposed in the plus direction, for example, of X axis, Y axis, and Z axis with the control localizer as the center, thereby setting a base coordinate system for measuring the three dimensional coordinate of the localizer. Then, the localizers are disposed in areas to be monitored inside/outside the house, and the three dimensional coordinates of the individual localizers are registered based on the coordinate system. An authorized member of the house (such as a resident) holds a localizer which can wirelessly transmits the ID code as a movable localizer.

An external guard surface is virtually set outside the house such that it surrounds the house, and one or more internal guard surfaces are virtually set inside the house such that it surrounds a specified area inside the house (see FIG. 1(*a*)).

Namely, the internal guard surface can exist only inside the external guard surface.

When all of the movable localizers go out from the external guard surface, the absent-at-home guard process is automatically executed (see FIG. 1(*b*)).

When all of the movable localizers existing inside the external guard surface come into the internal guard surfaces, the at-home guard process is automatically executed (see FIG. 1(*c*)).

When one or more movable localizers exist in an area between the internal guard surfaces and the external guard surface, a non-guard process is automatically executed (see FIG. 1(*d*)).

In a case where the internal guard surface is not set, such as an application to the cabin of a vehicle, when all of the movable localizers go out from the external guard surface, the absent-at-home guard process is set, and the non-guard process is set otherwise.

The internal guard surface and the external guard surface are set as follows. Namely, after the fixed localizers are installed inside/outside the house, the system is set to an external guard surface setting mode. Then, a member carrying the movable localizer presses a location registering button on the movable localizer at a location to be registered as a point on the external guard surface while going around a house. By conducting this step for a sufficient number of locations, registration of the three dimensional coordinate of the points on the external guard surface is completed. Parameters of a rectangular solid serving as the external guard surface are obtained by using the three dimensional coordinate of the points on the external guard surface registered in this way. Then, one or more internal guard surfaces are set. For setting the internal guard surface, the system is set to an internal guard surface setting mode by operating the control localizer. Then, the location registering button is pressed at a proper location to record the multiple three dimensional coordinates of the movable localizer when the button is pressed for the individual single internal guard surface (surface of a closed internal guard area) while the movable localizer is being moved for setting the internal guard surfaces. By using the multiple three dimensional coordinates registered in this way, parameters of a rectangular solid serving as the internal guard surface are obtained. After all the internal guard surfaces to be set are set, the control localizer is changed to an execution mode. Consequently, the system operates while automatically switching among three processes including the absent-at-home guard process, the at-home guard process, and the non-guard process according to the positional relationship between the movable localizer and the internal guard surfaces/the external guard surface. When an actuator (such as a speaker and a white smoke generating unit) is integrated into the localizer, the localizer located at an intruder generates alarm sound or white smoke in the absent-at-home guard process. When the intruder moves inside the house, the localizer generating the alarm sound and the localizer generating the white smoke change following the intruder. The actuator is controlled such that an intruder is discouraged to approach the internal guard surface or such that a house member inside the internal guard surface can evacuate in a direction departing from the intruder in the at-home guard process.

DETAILED DESCRIPTION OF THE PREFFERED EMBODIMENTS

An applicant refers to a system for comparing/monitoring a distance matrix between nodes with a matrix at a normal time in a wireless network as a Hagoromo system, and its concept is present in the following Web site.

http://www.hagoromoweb.com/

The Hagoromo system is also described in the U.S. patent application Ser. No. 10/200,522 (applied on Jul. 23, 2002) whose inventor is one of the inventors of the present invention.

In the present invention, in a wireless network including fixed localizers, the operation principle is monitoring a matrix of distances between the localizers (matrix including the distance between the localizer (s) and the localizer (t) defined as Dist (s, t)).

It is desirable to use a localizer incorporating a battery. This is that the localizer operating on a battery can react against a case where a person tries to intrude after disconnecting the power supplied for a house. As the battery, different types of batteries including a fuel cell and a lithium ion battery may be used. Also, a rechargeable battery may be used in combination with an AC power supply. A localizer disposed outdoors may further include a solar cell, and an indoor localizer may further receive an AC power supply. As a result, the frequency of replacing the battery reduces. To easily install the localizer on a subject (such as a wall, a door, a safe, and glass), a double-sided fastener supplied from Velcro Industries B. V. or Kuraray Co., Ltd., for example, may be used.

A localizer whose technology is disclosed in U.S. Pat. No. 5,748,891 may be used. With this localizer, the distance between the localizers can be measured, and a change is generated in the waveform of a radio signal exchanged between the localizers when an object is present in a space between the localizers. These pieces of information are collected by the control localizer using communication function between the localizers. Technology disclosed in Japanese patent Laid-Open Nos. 2002-228744 and 2000-111638 publications may be used along with GPS technology and wireless communication technology to realize the localizer. Namely, a radar function is used to measure the distance to an object between the nodes, simultaneously, a function of a GPS receiver held by the node is used to measure the location of the node, and the wireless communication function is used to transmit information on the distance to the object detected between the nodes, and information on the location of the node to another node. Based on FIG. 6, different types of the localizers are described.

Figure 6A:
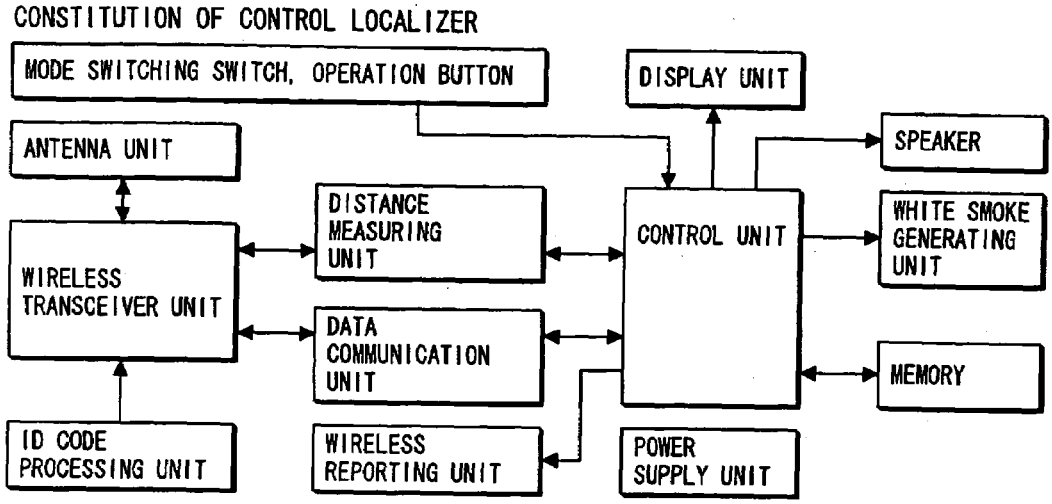
FIG. 6(*a*) is a constitution drawing of the control localizer, FIG. 6(*b*) is a constitution drawing of a fixed localizer, and FIG. 6(*c*) is a constitution drawing of a movable localizer.
Figure 6B:
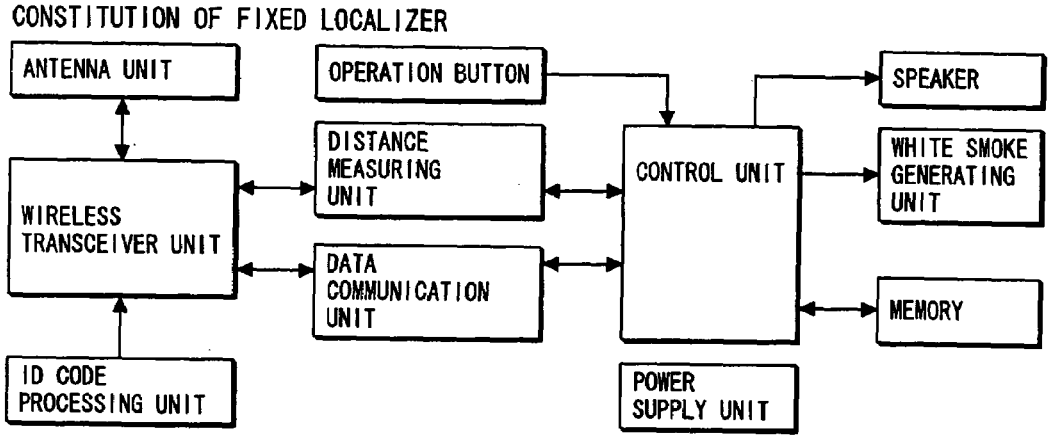
Figure 6C:
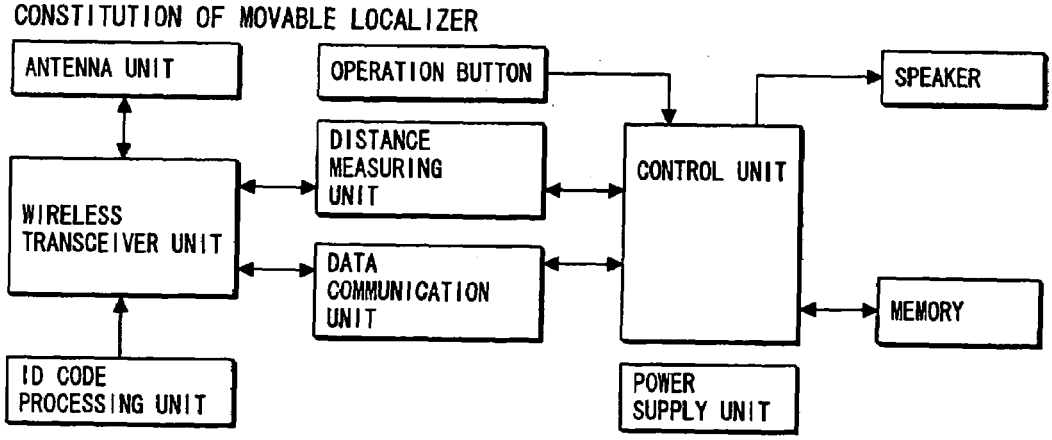

In the control localizer shown in FIG. 6(*a*), an ID code processing unit stores both ID's for the individual localizers, and an ID assigned to an individual network (an individual network for a single house when the system is provided as a home security system) which this localizer belongs to. A wireless transceiver unit uses the ID assigned to the individual network to modulate a signal, transmits it, and uses the ID assigned to the individual network to demodulate a received signal. Consequently, interference with a localizer belonging to another network is avoided. An antenna unit is used by the wireless transceiver unit for transmitting/receiving radio wave. A distance measuring unit transmits a pulse train for measuring the distance to another localizer, and receives a pulse train from another localizer through the wireless transceiver unit. The distance measuring unit calculates the distance based on a difference in time between a time when a destination localizer transmits a pulse train and a time when the own localizer receives the pulse train. A data communication unit uses the wireless transceiver unit to conduct data communication with another localizer. A control unit supervises overall operation of the control localizer, and includes a CPU. The control unit is provided with a speaker for generating alarm sound, a white smoke generating module for repulsing an intruder, and a wireless reporting unit for wirelessly reporting to an external predetermined person (such as a cellular phone of a house owner and a telephone of a security company). It is further provided with a memory for storing different types of parameters (such as parameters of the external guard surface and the Fingerprint). It is also provided with a mode switching switch and an operation button for selecting a mode such as a coordinate system setting mode, an external guard surface setting mode, an internal guard surface setting mode, and execution mode.

Though the structure and the operation of the fixed localizer shown in FIG. 6(*b*) are similar to those of the control localizer, the difference includes absence of the wireless reporting unit and a display unit. The fixed localizer includes a coordinate system setting button, and operation of setting a coordinate system with the control localizer as the origin is conducted when this button is pressed. Detailed description is provided in [How to set three dimensional coordinate system].

Though the structure and the operation of the movable localizer shown in FIG. 6(*c*) are similar to those of the fixed localizer, the difference includes absence of the white smoke generating module. It is assumed that a person always carries the movable localizer while the person is wearing it as he or she wears a wristwatch or a pendant.

Figure 1:
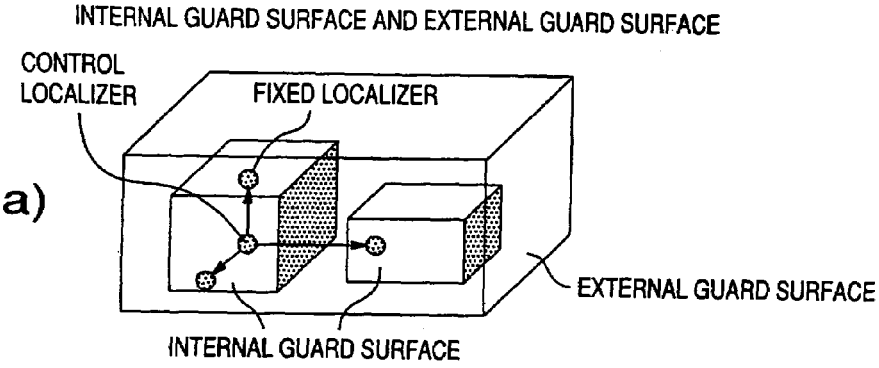
FIG. 1(*a*) describes internal guard surfaces and an external guard surface, FIG. 1(*b*) describes an absent-at-home guard process, FIG. 1(*c*) describes an at-home guard process, and FIG. 1(*d*) describes a non-guard process.
Figure 1:
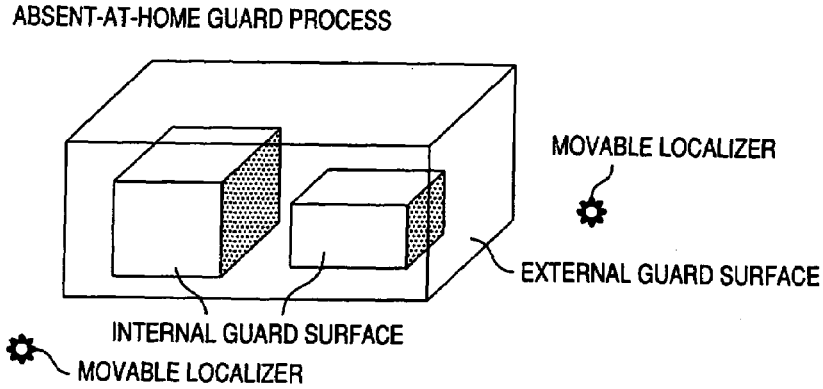
Figure 1:
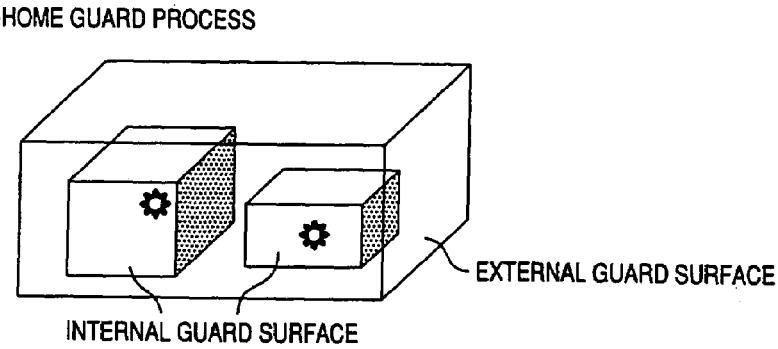
Figure 1:
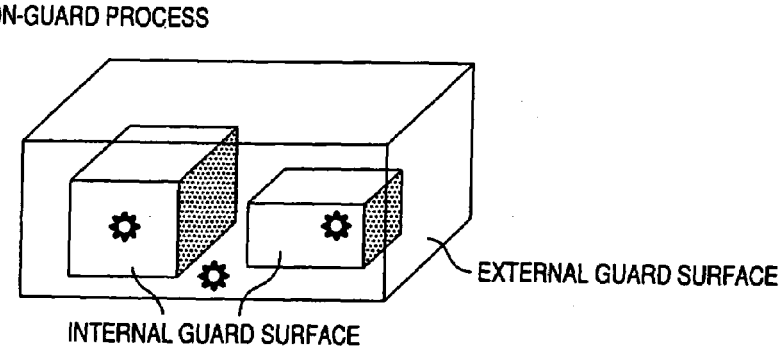
Figure 2:
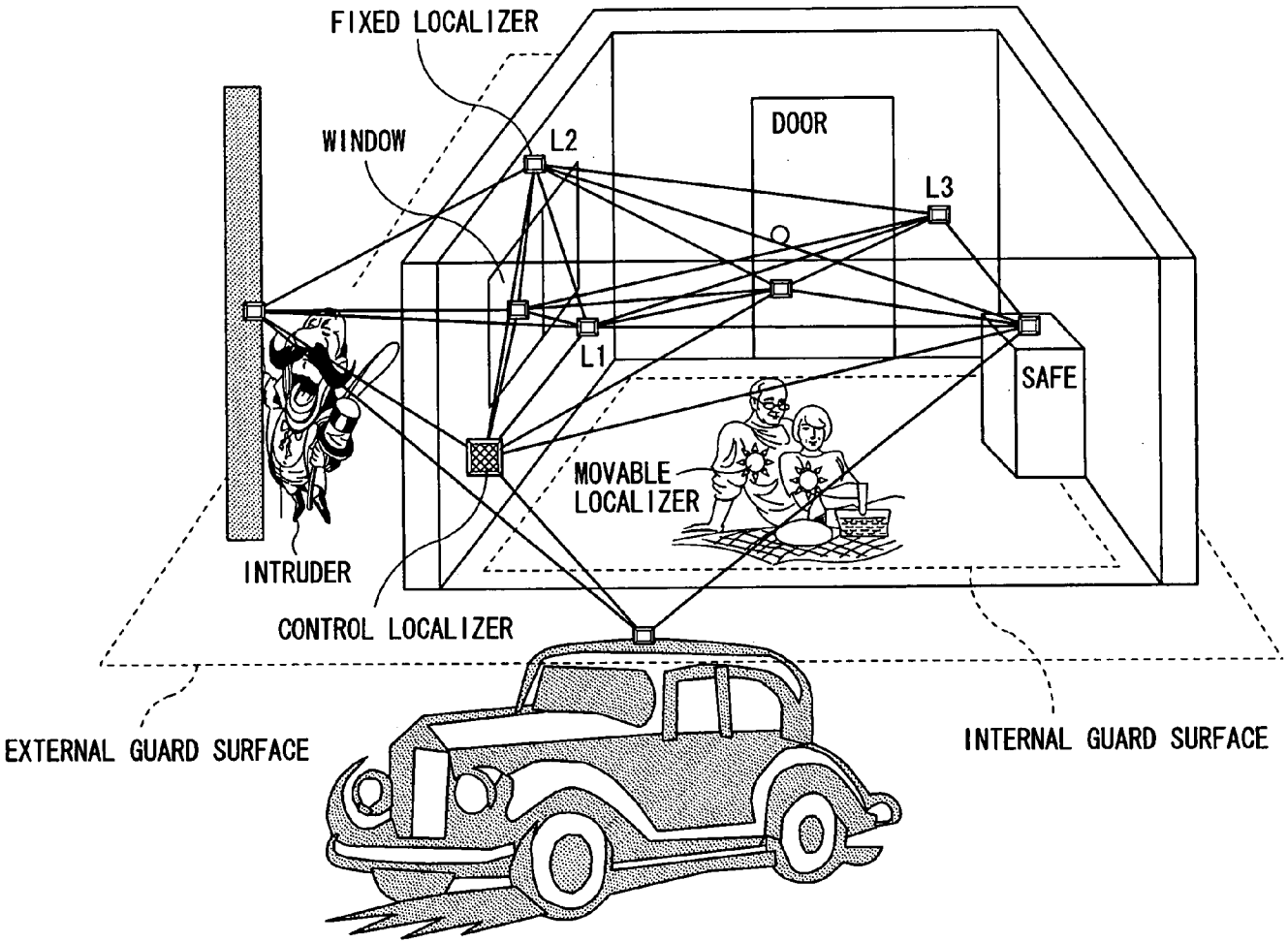
FIG. 2 is a conceptual drawing of a system.

The operation of the present system is specifically described based on FIG. 2. The localizer is mounted on a fixed object such as a window glass, a neighborhood of a window frame in a room, a surface of a door in a room, a surface of a wall or a ceiling in a room, an exterior wall surface of a house, an exterior pillar, and a gate pillar as a fixed localizer. Also, a localizer is mounted on an outdoor vehicle, an indoor electric appliance, and a safe which highly tend to be stolen. However, a movable localizer is mounted on a vehicle which is assumed to move. Even a movable localizer which is stationary for more than a predetermined period is automatically added to a wireless network including the fixed localizers. As a type of the fixed localizer, there exists the control localizer which simultaneously includes the control function, the function for communicating with the outside, and the like. It is assumed that an authorized member of the house (such as a family member and a lodger) carries a localizer wirelessly transmitting a specific ID code as the movable localizer.

[How to Set Three Dimensional Coordinate System]

The description is provided based on FIG. 2. An operator sets the mode of the control localizer to coordinate system setting. A fixed localizer L1 is selected from the fixed localizers which have been installed, and the operator presses the coordinate system setting button provided for this fixed localizer L1. Consequently, the control localizer and the fixed localizer L1 measure the mutual distance between them, and simultaneously, a one dimensional coordinate system is set such that the control localizer is the origin, and the fixed localizer L1 is set as the positive direction of X axis.

Figure 4:
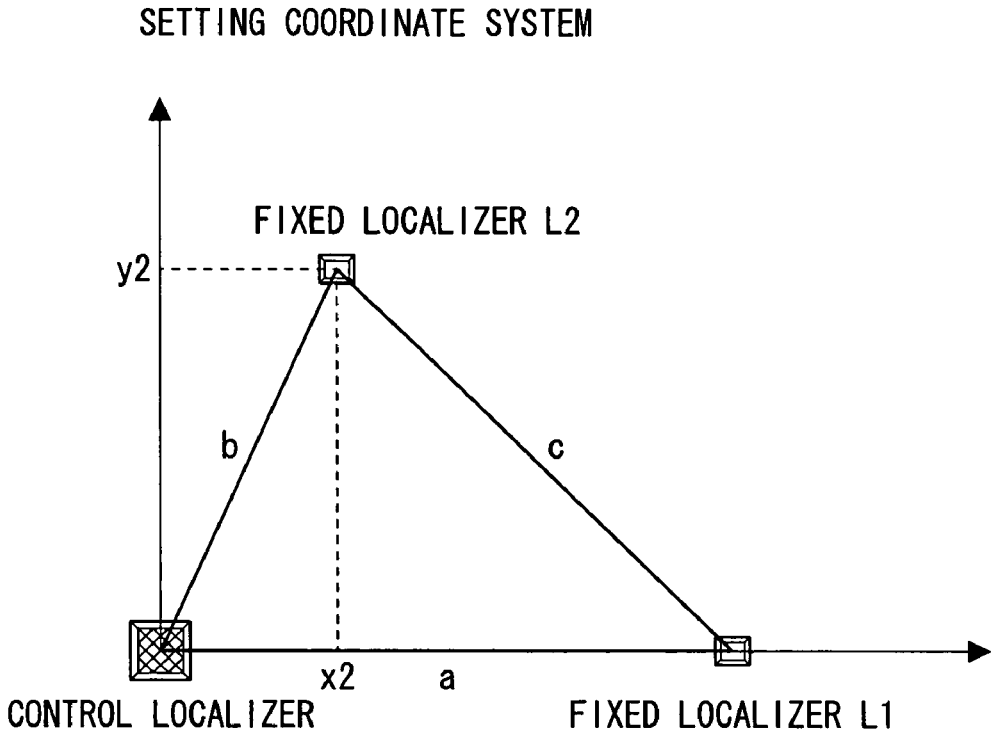
FIG. 4 describes setting of a coordinate system.

Then, a fixed localizer L2 which exists on the same plane on which the control localizer and the fixed localizer L1 exist, and the coordinate system setting button on this fixed localizer L2 is pressed. As a result, the control localizer and the fixed localizer respectively calculate the distance to the fixed localizer L2. The distance between the control localizer and the fixed localizer is defined as (a). The distance between the control localizer and the fixed localizer L2 is defined as (b), and the distance between the fixed localizer L1 and the fixed localizer L2 is defined as (c). As a result, as shown in FIG. 4, the following equations are obtained in terms of the two dimensional coordinate (x2, y2) of the fixed localizer L2.

$$x2=(c^2-b^2-a^2)/2a$$

$$y2=(b^2-x2^2)^{1/2}$$

In this coordinate system, the control localizer exists at the origin, and its three dimensional coordinate is (0, 0, 0). The three dimensional coordinate of the fixed localizer L1 is (a, 0, 0). The three dimensional coordinate of the fixed localizer L2 is (x2, y2, 0). Then, the fixed localizer L3 is selected at a location which does not exist on the plane formed by the control localizer, and the fixed localizers L1 and L2, assown in FIG. 2.

After the three dimensional coordinates of the control localizer, L1, and L2 are determined by the process described above, the distance between the control localizer and L3, the distance between L1 and L3, and the distance between L2 and L3 are measured. Based on the measured distances, the three dimensional coordinate (x3, y3, z3) of the fixed localizer L3 is obtained by solving simultaneous equations where the three dimensional coordinate of the fixed localizer L3 is set as unknown. The three dimensional coordinates of the individual fixed localizers paired with the node ID of the localizers are recorded on the control localizer. As a result, when the distances between three or more localizers whose three dimensional coordinate is known and a localizer of interest are obtained, the three dimensional coordinate of the localizer of interest is obtained by solving simultaneous equations. When this state is achieved, the setting of the three dimensional coordinate system has been completed.

[Registering Three Dimensional Coordinates of Entire Fixed Localizers]

After setting the three dimensional coordinate system of the system has been completed, the individual fixed localizers in the system measure the distance to the fixed localizer whose three dimensional coordinate has been registered, and the measured distance is transmitted to the control localizer as information in a format described below.

Transmission Format for Measured Distance:

(Own Node Number, Destination Node Number, Distance Between Own Node and Destination Node)

The control localizer records a matrix for the distances between the localizers, or a list of the location coordinates of the localizers as a Fingerprint which serves as unique information relating to the network including the control localizer and the fixed localizers. When an element of the inter-localizer distance matrix which indicates the distance between the localizer (s) and the localizer (t) is defined as M(s,t), it is represented by the following equation.

$$M(s,t)=\text{Distance}(s,t):\ \text{if measuring distance was successful.}$$

$$-1:\ \text{if measuring distance failed.}$$

[External Guard Surface Setting]

When setting the three dimensional coordinate system has been completed, the button operation on the control localizer sets the mode to the "external guard surface setting" mode. Then, the external guard surface is set as follows while one movable localizer is being carried.

(1) The movable localizer is moved to a location supposed to be close to the external guard surface.

(2) The location registering button on the movable localizer is pressed. Other fixed localizers individually measure the distance to the movable localizer, and the measured distances in the transmission format described above are transmitted to the control localizer. The control localizer calculates and records the three dimensional coordinate based on the measured distances from the individual fixed localizers.

(3) Steps (1) and (2) are repeated until the registered points reach a predetermined number (such as ten points). The person registering the locations must arrange lines connecting the registered points with each other such that the lines exist on all the side surfaces of the assumed external guard surface.

(4) The minimum rectangular solid surrounding the registered points which have been registered up to Step (3) is obtained. As the bottom surface and the top surface of the minimum rectangular solid, the bottom surface is defined as one meter below the average of the z coordinates (coordinates in the vertical direction) of the individual registered points, and the top surface is defined as one meter above the average. This is that it is difficult to move the movable localizer to a neighborhood of the floor or a neighborhood of the ceiling.

(5) The surface of the minimum rectangular solid obtained in Step (4) is extended by a predetermined ratio (such as 150%) about its center point and registered as the external guard surface in the control localizer. This process is conducted because there may be a case where it is difficult to move outside the house for setting the registered points outside the house while carrying the movable localizer, and the external guard surface can be set outside the house by moving only inside the house.

[Internal Guard Surface Setting]

This process is skipped if the non-guard process is conducted when an authorized person exists inside in such a case as a vehicle. However, as in the home security system, when intrusion from the outside is guarded even if an authorized person is at home, this internal guard surface is set. When there is no authorized person (a holder of the movable localizer) between the internal guard surface and the external guard surface, since there is no person who monitors intrusion through the external guard surface, it is supposed that the system automatically executes a monitor process.

By the button operation on the control localizer, the "internal guard surface setting" mode is set. Then, the internal guard surface is set as follows while one movable localizer is being carried.

(1) The movable localizer is moved to a location supposed to be close to the internal guard surface.

(2) The location registering button on the movable localizer is pressed. Other fixed localizers individually measure the distance to the movable localizer, and the measured distances in the transmission format described above are transmitted to the control localizer. The control localizer calculates and records the three dimensional coordinate based on the measured distances from the individual fixed localizers.

(3) Steps (1) and (2) are repeated until the registered points reach a predetermined number (such as ten points). The person registering the locations must arrange lines connecting the registered points with each other such that the lines exist on all the side surfaces of the assumed internal guard surface.

(4) The minimum rectangular solid surrounding the registered points which have been registered up to Step (3) is obtained. As the bottom surface and the top surface of the minimum rectangular solid, the bottom surface is defined as one meter below the average of the z coordinates (coordinates in the vertical direction) of the individual registered points, and the top surface is defined as one meter above the average. This is that it is difficult to move the movable localizer to a neighborhood of the floor or a neighborhood of the ceiling.

(5) The obtained minimum rectangular solid is registered in the control localizer as the internal guard surface.

[Execution Mode]

Figure 5:
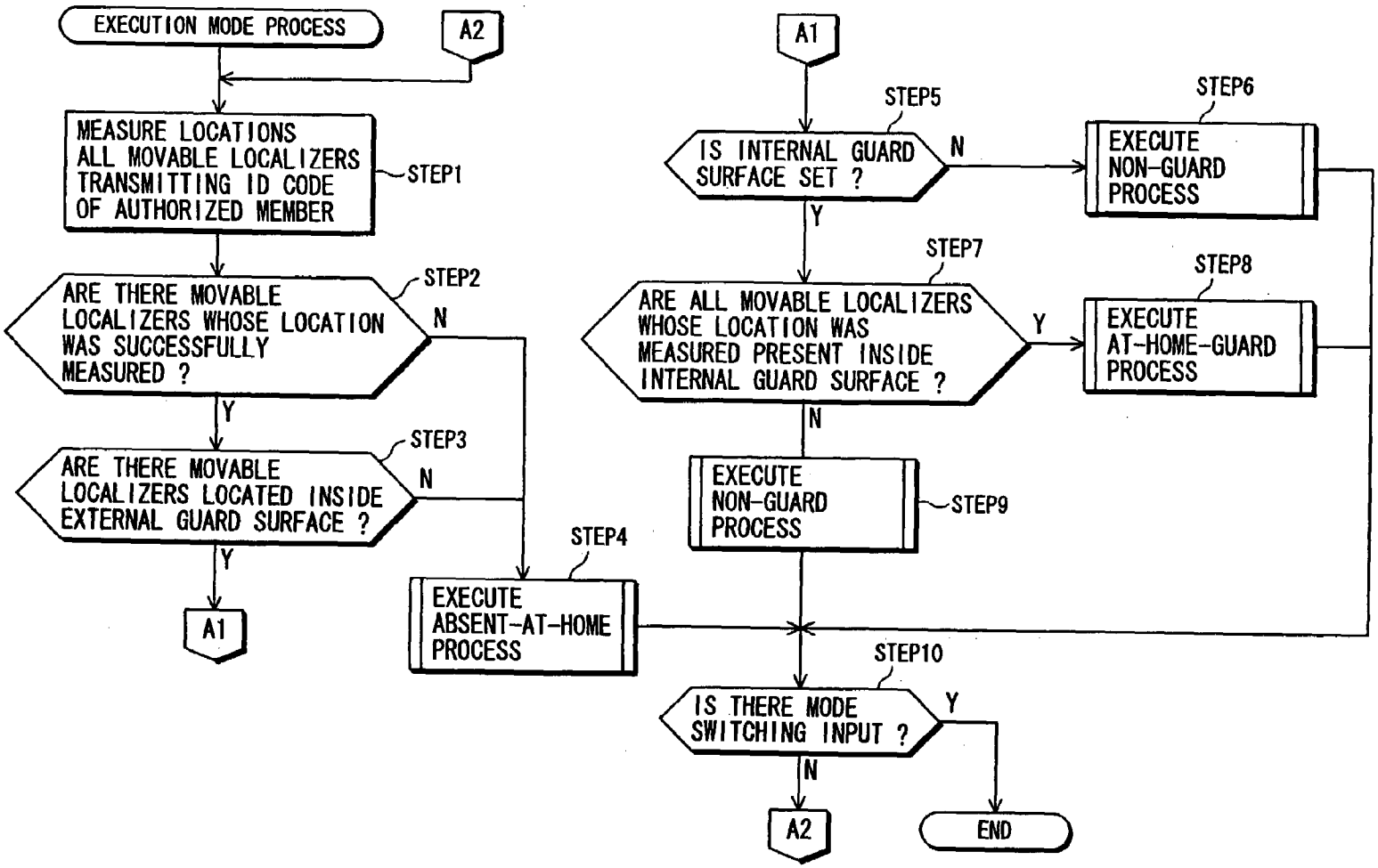
FIG. 5 is a flowchart for a process in an execution mode at a control localizer.

After the external guard surface is set, and the process for setting the internal guard surface if necessary is completed, the execution mode process shown in FIG. 5 is executed. Even during executing this mode, it is possible to use the switch of the control node to switch to another mode (such as the external guard surface setting). Namely, the execution mode is terminated, and the mode is switched to another mode to be started in Step 10 in FIG. 5.

In this execution mode, the process to be started is automatically switched according to the positional relationship between the movable localizer and the external guard surface, and between the movable localizer and the internal guard surface. Namely, three processes including the absent-at-home guard process, the at-home guard process, and the non-guard process are automatically started at proper timing.

[Case of Application to Home Security System]

Referring to FIG. 2, description is provided for a case where the system is applied to a home security.

In FIG. 2, the control localizer is installed on a wall in a house. Then, the fixed localizers L1 and L2 are installed on the same wall on which the control localizer is installed. Further, the fixed localizer L3 is installed on a wall different from this wall. The individual localizers are mounted on the subjects with a double-sided fastener. In the method described before, it is assumed that a three dimensional coordinate system is set with the control localizer as its origin, and the three dimensional coordinates of all of the fixed localizers are measured, and are recorded along with the ID numbers of the individual localizers in the control localizer. Then, it is assumed that the external guard surface and the internal guard surface have already been set using the method described before. At this moment, a resident, who is an authorized member of this house, wears the movable localizer on the body as he or she wears a pendant or a wristwatch.

In the execution mode, the control localizer instructs the individual fixed localizers in the network to measure and report the distance to the movable localizer. Each time after the individual fixed localizers measure the distances to the individual movable localizers, the fixed localizers report the distances to the control localizer in the measured distance transmission format described above. The control localizer calculates and memorizes the three dimensional locations of the individual movable localizers based on the report from the individual fixed localizers (Step 1).

If there exist no movable localizers at locations where the distance to the fixed localizer can be measured, or there exist only movable localizers whose battery is exhausted, and which cannot measure the distance, N (No) is determined in Step 2. Also, since the control localizer and the fixed localizer cannot communicate with the movable localizer belonging to another network, or cannot measure the mutual distance to it, if there exist only movable localizers belonging to another network at a location where the communication or the distance measurement is possible, N is determined in Step 2. The movable localizer belonging to the own network uses the ID code unique to the own network for the communication and the distance measurement. When there are one or more movable localizers which belong to the own network, and to which the distance measurement is successful, Y (Yes) is determined in Step 2, and the process moves to Step 3.

It is determined whether the location of the movable localizer exists inside the external guard surface based on comparing the coordinates indicating the range of the external guard surface and the location coordinate of the movable localizer. As a result of the determination, if it turns out that there exist no movable localizers inside the external guard surface, namely the locations of the entire movable localizers whose location can be measured are outside the external guard surface, N is determined for Step 3, and the process moves to Step 4 of the absent-at-home guard process. This means that the system automatically executes the absent-at-home guard process immediately after an authorized member wearing the movable localizer leaves the house. In a conventional home security system, it is necessary to operate a button for setting the absent-at-home guard mode when one leaves home, and this setting is often neglected, and the home security system does not operate when it should. This problem can be solved by this operation.

In Step 4, the absent-at-home guard process is executed. Specifically, the following processes are executed.

(1) In the network including the fixed localizers and the control localizer, the inter-localizer distance matrix is generated by measuring the distances between the localizers, and is compared with the Fingerprint recorded in the control localizer. As described later, note that the Fingerprint has been updated in the non-guard process executed in Step 6 or Step 9 to the inter-localizer distances at that moment. Thus, a difference between the Fingerprint updated most recently and the current inter-localizer distance matrix is detected. This difference is calculated as the sum of the absolute values of the difference between the corresponding elements for which the distance can be measured in the Fingerprint and the inter-localizer distance matrix. If the sum exceeds a threshold, it is determined that abnormality is present. When the fixed localizer is installed on a window, a door, or a safe as shown in FIG. 2, if the window moves, or the door moves, the distance between the localizer installed on the window or the door and another localizer changes. The same result is also achieved if the safe moves. Consequently, the inter-localizer distance matrix changes.

(2) Then, it is also detected whether a human exists between the localizers. When a human exists between the localizers, since the waveform of the radio signal communicated between the localizers changes due to an influence of the human body, the existence of the human body between the localizers is detected by waveform analysis. The localizer which detects the existence of the human body reports information in the following format to the control localizer The human body is detected between the localizer indicated by the own node number, and the localizer indicated by the destination node number. As a detection parameter for this detection, a flag indicating the existence of a human body, or a parameter indicating the thickness of a human body may be used.

Human Body Detection Report Format:

(Own Node Number, Destination Node Number, Parameter Indicating Human Body Detection)

When a report indicating detection of a human body is received, it can be determined that abnormality exists.

Figure 7:
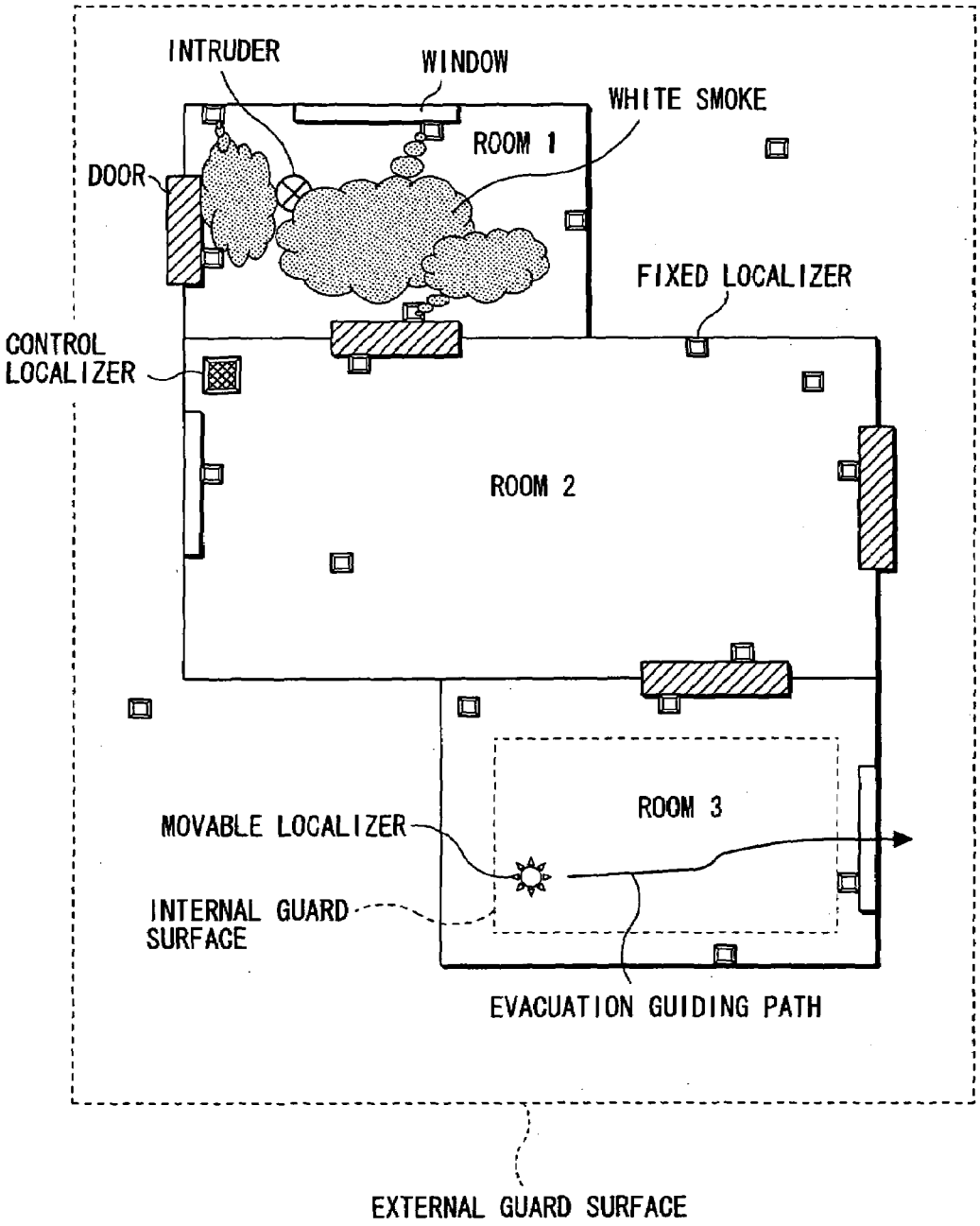
FIG. 7 describes repulsion of an intruder, and evacuation guidance for a residential member.

(3) As a result of the processes in (1) and (2), if abnormality in terms of either the inter-localizer distance matrix or the human body detection is detected, a predetermined reaction process is executed (see FIG. 7).

As the reaction process, generating alarm sound at high loudness from a speaker integrated into the control localizer and the fixed localizer, wirelessly reporting the occurrence of the abnormality to a predetermined report destination from the control localizer, and generating cloud of white smoke from the control localizer or the fixed localizer are conceivable. It is possible to generate white smoke harmless to the human body and to different types of apparatuses by heating mixture of propylene glycol and water up to about 200 degree centigrade. Therefore, when a localizer incorporating a white smoke generating module is prepared in advance, it is possible to generate white smoke on intruder detection. Also, the control localizer may transmits a command to the individual fixed localizers through wireless communication in order that only localizers which detect a human body, localizers whose three dimensional coordinate changes, and localizers around them generate alarm sound and simultaneously generate white smoke. Consequently, the alarm sound and the white smoke are generated in a neighborhood of a location where an intruder intruded, and destinations where the intruder moves. Namely, this is a reaction as an actuator network where actuators applying action of generating white smoke and actuators applying action of generating alarm sound are dispersed in the space, and form a wireless communication network, and, according to the location where abnormality occurs, the actuator appropriate for reacting against the abnormality is activated at the location. In FIG. 7, when an intruder who has intruded from a window of a room 1 is present, a fixed localizer attached to the window generates alarm sound and releases cloud of white smoke assuming that the intruder is present close to the fixed localizer whose location is moved by opening the window. Fixed localizers close to the fixed localizer attached to the window of the room 1 also release white smoke.

When a movable localizer exists inside the external guard surface, the process moves to Step 5. In Step 5, it is determined whether the internal guard surface is set or not. As an internal guard surface, when a resident of a house is sleeping in a bedroom at midnight, for example, the bedroom area is set to the internal guard surface. As a result, it is possible to control the operation of the actuators so as to prevent the intruder from approaching the internal guard surface (such as the bedroom) by properly controlling the actuator network. When the internal guard surface is not set, the non-guard process is executed in Step 6. When the internal guard surface is set, the process moves to Step 7.

In Step 7, it is determined whether all the movable localizers whose location can be measured exist inside the internal guard surface. In this determination, if the internal guard surface is the bedroom, for example, it is determined whether the members of the house are present in the bedroom. If the determination result is Y, the at-home guard process is executed in Step 8.

The following processes are executed in the at-home guard process in Step 8.

(1) In the network including the fixed localizers and the control localizer, the inter-localizer distance matrix is generated by measuring the distances between the localizers, and is compared with the Fingerprint recorded in the control localizer. As described later, note that the Fingerprint has been updated to the inter-localizer distances in the non-guard process executed in Step 6 or Step 9 at that moment. Thus, a difference between the Fingerprint updated most recently and the current inter-localizer distance matrix is detected. This difference is calculated as the sum of the absolute values of the difference between the corresponding elements for which the distance can be measured in the Fingerprint and the inter-localizer distance matrix. Data of a difference generated by the movement of the localizer inside the internal guard surface is not used for calculating the sum. This is to prevent the system from detecting the movement of the house member inside the internal guard surface as abnormal. If the sum exceeds a threshold, it is determined that abnormality is present. When the fixed localizer is installed on a window, a door, or a safe as shown in FIG. 2, if the window moves, or the door moves, the distance between the localizer installed on the window or the door and another localizer changes. The same result is also achieved if the safe moves. Consequently, the inter-localizer distance matrix changes.

(2) Then, it is detected whether a human exists between the localizers in a space except for the inside of the internal guard surface. When a human exists between the localizers, since the waveform of the radio signal communicated between the localizers changes due to an influence of the human body, the existence of the human body between the localizers is detected by waveform analysis. The localizer which detects the existence of the human body reports information in the following format to the control localizer. The human body is detected between the localizer indicated by the own node number, and the localizer indicated by the destination node number. As a detection parameter for this detection, a flag indicating the existence of a human body, or a parameter indicating the thickness of a human body may be used.

Human Body Detection Report Format:

(Own Node Number, Destination Node Number, Parameter Indicating Human Body Detection)

When a report indicating detection of a human body is received, it can be determined that abnormality exists.

(3) When an intruder is detected in the process above, the presence of the intruder is reported to the members of the house inside the internal guard surface, and simultaneously, the intruder is discouraged to approach the internal guard surface by executing the following processes from A to E. Further, if possible, the members of the house are guided for evacuation to a direction far from the existing location of the intruder (see FIG. 7).

A. The localizers at the location where the intruder is detected (the localizer whose coordinate changed or a localizer which detected a human body between itself and another localizer) generate alarm sound and simultaneously generate white smoke. White smoke is generated from the fixed localizers including one attached on the window of the room 1 in FIG. 7.

B. The presence of the intruder is reported with the alarm sound to the house members present inside the internal guard surface.

C. The localizers outside the internal guard surface, and within a predetermined distance from the existing location of the intruder generate the alarm sound and white smoke.

D. The localizer within a predetermined distance from the movable localizer and farthest from the intruder generates sound different from the alarm sound (evacuation guiding sound). The house members can automatically get away from the intruder by moving in the direction approaching the evacuation guiding sound.

E. When the distance between the movable localizer and the intruder becomes within a predetermined distance, the localizer closest to the intruder invokes a repulsing function if it incorporates the repulsing function. The repulsing function includes spraying lachrymator and increasing the loudness of the alarm sound. With this function, the house members are defended from the intruder who has come close to the house members.

In the non-guard process in Step 6 and Step 9, the positions of the individual fixed localizers and the control localizer, and the distances between the localizers are measured, the Fingerprint is updated, and it is memorized in the control localizer. Also, at this moment, the remaining capacity of the battery and the remaining quantity of the material of the white smoke in the individual localizers are self-diagnosed, and if there is a problem, the control localizer indicates the situation as a display or a sound.

In Step 10, it is checked whether an input instructing a transition to another mode such as the internal guard surface setting and the external guard surface setting has been received at the control localizer. If the input exists, the execution mode is terminated, and otherwise, the step returns to Step 1.

[Case of Application to Car Security System]

Figure 3:
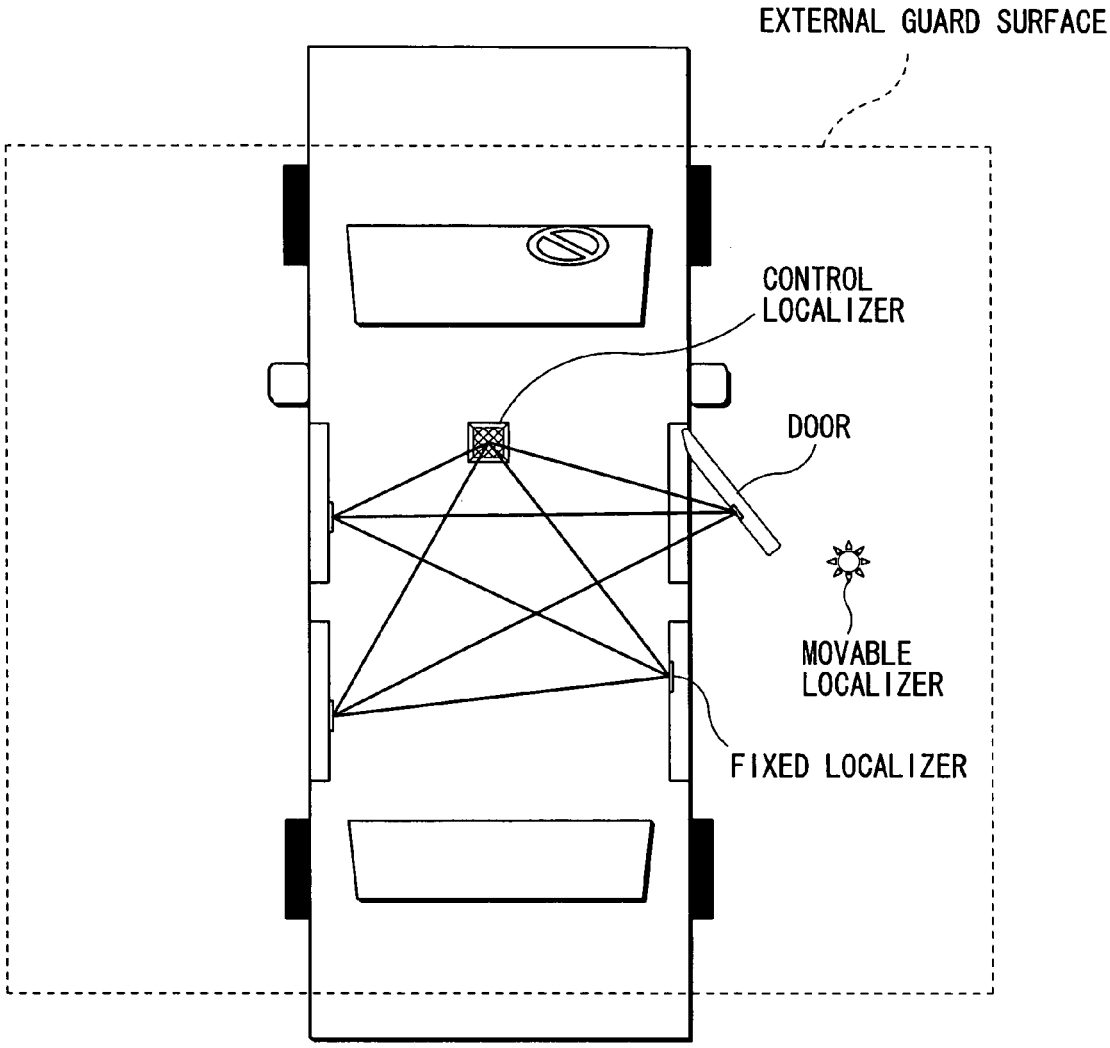
FIG. 3 describes a system applied to a vehicle.

A case where the system is applied to a car security system is described based on FIG. 3.

A control localizer is disposed at an arbitrary location other than the doors in the cabin. One or more fixed localizers are disposed inside the individual doors. An authorized member using this car carries a movable localizer. Setting the three dimensional coordinate system, setting the three dimensional coordinates of all the fixed localizers, and setting the external guard surface are conducted using the methods described above. Then, the process moves to the execution mode. The execution mode is processed according to FIG. 5. Since the internal guard surface is not set, the at-home guard process is not started. Thus, only two of the absent-at-home guard process, and the non-guard process exist. The operation described above is conducted in the absent-at-home guard process, and the non-guard process. In the absent-at-home process, if the fixed localizer incorporates a speaker for generating alarm sound as an actuator, and it also incorporates a white smoke generating module, the alarm sound is generated, and simultaneously, cloud of white smoke is generated in the cabin when the door is opened. Consequently, even if intrusion into the cabin is tried, since the view is obstructed in the cabin, illicit action is restrained.

With this invention, since the guard process and the non-guard process are automatically switched, it is possible to prevent the switching from being neglected, and to prevent the system from malfunctioning. In addition, the actuator operates according to the location of an intruder so as to repulse the intruder. Further, it is possible to prevent the intruder from approaching an authorized member in the area, and to guide the authorized member in the area for evacuation while avoiding the intruder. Additionally, it is possible to use the movable localizer for easily setting and registering the guard surface which should be set for automatically switching between the guard process and the non-guard process.

What is claimed is:

1. An anti-intruder security system executing a predetermined reaction process on detection of intrusion into a facility to be guarded, the system comprising:

member location detecting means for detecting the location of an authorized member who uses said facility;

intrusion location detecting means for detecting the location of intrusion into said facility;

actuators disposed at multiple locations in said facility, and executing said reaction process against said intrusion; and invocation control means for invoking said reaction process by selecting said actuator for conducting said reaction process according to a relationship between the location of said authorized member detected by said member location detecting means, and the location of said intrusion detected by said intrusion location detecting means.

2. The anti-intruder security system according to claim 1, wherein said invocation control means controls such that one or more of said actuators including the actuator closest to the location of said intrusion are selected so as to invoke said reaction process when the distance between the location of the intrusion and the location of said authorized member becomes equal to or less than a predetermined value.

3. The anti-intruder security system according to claim 1, wherein said invocation control means controls such that an actuator within a predetermined distance from said authorized member, and farthest from said intrusion location, supplies the authorized member with an output for evacuation guidance.

4. The anti-intruder security system according to claim 1, wherein said actuator generates white smoke.

5. The anti-intruder security system according to claim 1, wherein said member location detecting means detects the location of a device which can wirelessly transmit an ID code corresponding to said facility.

6. The anti-intruder security system according to claim 1, wherein said member location detecting means detects the location of a device which can wirelessly transmit an ID code corresponding to said facility, and incorporates one of said actuators reacting against intrusion.

7. An anti-intruder security system executing a predetermined reaction process on detection of intrusion into a facility to be guarded, the system comprising:

member location detecting means for detecting the location of an authorized member who uses said facility;

intrusion location detecting means for detecting the location of intrusion into said facility;

external guard surface memorizing means for memorizing an external guard surface for invoking an absent-at-home guard process when said authorized member is not present inside;

internal guard surface memorizing means for memorizing an internal guard surface for invoking an at-home guard process when said authorized member is present inside;

actuators disposed at multiple locations in said facility, and executing said reaction process against said intrusion; and invocation control means for using the location of said authorized member detected by said member location detecting means so as to control the invocation of said absent-at-home guard process and said at-home guard process.

8. The anti-intruder security system according to claim 7, wherein said actuator generates white smoke.

9. The anti-intruder security system according to claim 7, wherein said member location detecting means detects the location of a device which can wirelessly transmit an ID code corresponding to said facility.

10. The anti-intruder security system according to claim 7, wherein said member location detecting means detects the location of a device which can wirelessly transmit an ID code corresponding to said facility, and incorporates one of said actuators reacting against intrusion.

11. The anti-intruder security system according to claim 10, wherein said device generates white smoke.

12. A localizer comprising:

an antenna unit;

a wireless transceiver unit connected with said antenna unit for transmitting/receiving information;

a distance measuring unit for transmitting/receiving a signal modulated by a specific code through said wireless transceiver unit so as to measure the distance to a device serving as a destination of the wireless transmission/reception, the specific code corresponding to an ID code of the network to which the localizer belongs;

a data communication unit for transmitting/receiving a second signal modulated by the specific code through said wireless transceiver unit so as to conduct data communication with the device serving as the destination of the wireless transmission/reception;

an actuator for executing a reaction process against intrusion; and a control unit responsible for overall control.

13. The localizer according to claim 12, wherein said actuator generates white smoke.

14. The localizer according to claim 12, further comprising:

human body detecting means for detecting the existence of a human body between the localizer and another localizer based on waveform analysis of a radio signal between the localizers; and anti-human processing means for using said actuator so as to conduct a reaction process against intrusion when the output from said human body detecting means indicates human body detection.

15. A method for using said localizer according to claim 12 which can measure a mutual distance so as to set a three dimensional coordinate system, the method comprising the steps of:

installing a first localizer at the origin of said coordinate system;

installing a second localizer at a location assumed as a predetermined direction of a first axis of said coordinate system;

installing a third localizer on a first surface which is the same surface on which said first localizer and said second localizer are disposed;

measuring the distance between said first localizer and said second localizer, registering the distance as the coordinate of the second localizer with respect to said first axis, respectively measuring the distances from the first and second localizers to said third localizer, and using a predetermined operation to calculate the coordinate of the third localizer with respect to the first axis, and the coordinate of the third localizer with respect to a second axis orthogonal to the first axis and present on the first surface;

installing a fourth localizer at a location not present on said first surface;

measuring distances from said fourth localizer to said first, second, and third localizers; and using a predetermined operation to obtain respective coordinates of the fourth localizer with respect to said first axis, said second axis, and a third axis orthogonal to said first surface, thereby obtaining a three dimensional coordinate system.

16. A method for using a movable localizer so as to set a guard surface in said three dimensional coordinate system set by said method according to claim 15, the method comprising the steps of:

repeating a predetermined number of times an operation of moving said movable localizer to the location of a point constituting said guard surface, supplying the movable localizer with a predetermined input, and registering the three dimensional coordinate of the location constituting said guard surface; and collecting a predetermined number or more of the three dimensional coordinates of said points constituting said guard surface, then, obtaining the minimum rectangular solid including said points constituting said guard surface, applying a predetermined conversion to the minimum rectangular solid as a base, and setting the surface of an obtained new rectangular solid as the guard surface.

17. A car security system comprising:

a control localizer installed inside a vehicle;

a fixed localizer installed on an internal surface of individual doors of said vehicle, and measuring the distance to another fixed localizer and to said control localizer;

a movable localizer held by a person who has authority of entering into/exiting from said vehicle; and abnormality determining means for monitoring a change in the distance between said localizers installed inside said vehicle when said movable localizer exists outside an external guard surface set by the localizers installed inside the vehicle, and determining an existence of abnormality when the change in distance satisfies a predetermined condition, wherein a predetermined reaction process is executed when said abnormality determining means determines abnormality.

18. The car security system according to claim 17, wherein said reaction process generates white smoke.

19. A sensor/actuator network system comprising:

a plurality of fixed nodes; and a control node, wherein each of said fixed nodes comprises:

sensing means for sensing an ambient environment;

wireless communication means;

an actuator for applying action to the outside; and control means for using said wireless communication means so as to transmit the information on said ambient environment detected by said sensing means to said control node, and simultaneously invoking said actuator in response to an instruction from the control node, said control node determines which of said fixed nodes should invoke said actuator based on said information on said ambient environment obtained from the fixed node, and then invokes the respective actuators of the determined fixed node to apply the action; and wherein said control node monitors information on the distance between said fixed nodes as said ambient environment information.

20. The sensor/actuator network system according to claim 19, wherein each of said fixed nodes is a fixed localizer, and said control node is a control localizer.

* * * * *